US005849098A

United States Patent [19]

Volkmann

[11] Patent Number: 5,849,098

[45] Date of Patent: Dec. 15, 1998

[54] PROCESS AND DEVICE FOR THE REDUCTION OF THE AMOUNT OF LIQUIDS REMAINING ON FLAT STOCK AFTER A ROLLING PROCESS

[76] Inventor: Thilo Volkmann, Zum Vulting 12, D-59514 Welver, Germany

[21] Appl. No.: 762,839

[22] Filed: Dec. 10, 1996

Related U.S. Application Data

[63] Continuation-in-part of Ser. No. 379,488, Feb. 1, 1995, abandoned.

[30] Foreign Application Priority Data

Aug. 1, 1992 [DE] Germany ..... 42 25 545.7

[51] Int. Cl.[6] ..... B08B 1/02; A47L 7/00

[52] U.S. Cl. ..... 134/15; 15/306.1; 15/309.1; 134/21

[58] Field of Search ..... 15/306.1, 308, 15/309.1, 401; 134/15, 21

[56] References Cited

U.S. PATENT DOCUMENTS

| | | | |
|---|---|---|---|
| 2,234,153 | 3/1941 | Herbert . | |
| 2,289,753 | 7/1942 | Capstaff | 15/309.1 |
| 2,774,684 | 12/1956 | Fucinari . | |
| 2,962,747 | 12/1960 | Ford . | |
| 3,195,163 | 7/1965 | Townley et al. . | |
| 3,297,469 | 1/1967 | Otis et al. . | |
| 3,398,022 | 8/1968 | Maust | 15/308 |
| 4,279,055 | 7/1981 | Jaggi et al. . | |
| 4,551,878 | 11/1985 | Turley et al. . | |
| 4,706,325 | 11/1987 | Michelson . | |
| 4,757,569 | 7/1988 | Muller et al. | 15/308 |
| 5,313,685 | 5/1994 | Kramer et al. | 15/309.1 |
| 5,317,781 | 6/1994 | Thayer et al. . | |

FOREIGN PATENT DOCUMENTS

| | | | |
|---|---|---|---|
| 56540 | 7/1982 | European Pat. Off. . | |
| 2212187 | 12/1972 | France . | |
| 2826367 | 12/1979 | Germany | 134/15 |
| 28 43 449 C2 | 4/1980 | Germany . | |
| 39 09016 Ai | 9/1990 | Germany . | |
| 61-210194 | 9/1986 | Japan . | |
| 1148413 | 6/1989 | Japan . | |
| 3008516 | 1/1991 | Japan . | |
| 3052707 | 3/1991 | Japan . | |
| 8500746 | 10/1986 | Netherlands . | |
| 185 414 | 10/1963 | Switzerland . | |
| 2 172 014 | 9/1986 | United Kingdom . | |

*Primary Examiner*—Terrence Till
*Attorney, Agent, or Firm*—Vickers, Daniels & Young

[57] ABSTRACT

A device for the removal and controlled reduction of the amount of liquid remaining on a flat stock is provided. The device is provided for coacting with a moving section of elongated flat stock, such flat stock moving in a direction generally parallel to the opposing edges such as after rolling process. Liquid used for lubricating during forming of the flat stock is removed by a gas stream which flows across the film of moisture transverse to the direction of motion. The device comprises a plurality of exhaust chambers which are open toward the edge of the flat stock, each of the exhaust chambers always located between two adjacent rolls and formed jointly by the rolls in at least one housing unit. Included in the housing is an exhaust chamber and exhaust port for exhausting a stream of gas flowing across the direction of motion of the flat stock. The gas and atomized liquid caused by the gas is removed from the chamber through an exhaust port connection located opposite from the flat stock.

49 Claims, 5 Drawing Sheets

PROCESS AND DEVICE FOR THE REDUCTION OF THE AMOUNT OF LIQUIDS REMAINING ON FLAT STOCK AFTER A ROLLING PROCESS

This application is a continuation-in-part of application Ser. No. 08/379,488, filed Feb. 1, 1995 now abandoned, which in turn claims priority of PCT/EP93/02016, filed Jul. 29, 1993, which in turn claims priority of German application P 42 25 545.7, filed Aug. 1, 1992.

The invention is related to a process and a device for the removal and the controlled reduction of the amounts of liquids, which remain on the rolling stock or other flat stock after a rolling process or a similar manufacturing process.

BACKGROUND OF THE INVENTION

In the case of the rolling process, for example, different liquid films are required on the rolling stock for certain processes affecting the surface of the rolling stock to be processed. Subsequently, such liquid films must be either completely removed or reduced to a defined residual amount. This concerns primarily the following liquids or mixtures or their emulsions: water, oil, kerosene, solvents (including those with a water base), acids or bases. The problem of removing these liquids either entirely or partially from the rolling stock after the rolling or manufacturing process has been known for some time along with various approaches toward solving it.

In connection with the cold rolling of aluminum, it has been proposed in GB 1006388 to remove the residues of an oil-in-water emulsion, which was used during the rolling process, in such a manner that a blast of air is directed at the rolling stock which has the emulsion on it. The emulsion is thus atomized, after which the atomized emulsion is exhausted along with the air used for the air blast process. Such a process is, however, only usable for the removal of small amounts of liquid. Due to the required large amount of air, a great deal of energy is used, the process is expensive, and importantly, is only applicable in the case of emulsions with a relatively low adhesion. This process is also burdened with a high noise level and the disadvantages associated with high noise.

Stripping devices have also been used. The object of stripping devices is to strip off the liquid remaining on the rolling stock. However, this stripping process is associated with the danger of forming scratches on the rolling stock and with a very high rate of wear of the stripping device. Furthermore, it is possible that the liquid can be pulled along by the device if the stripping device is floating on the surface, i.e. in an aquaplaning effect. This pulling-through of the liquid can, under certain conditions, also cause an undesirable formation of stripes of the residual liquid on the rolling stock, such as when more liquid is stripped off at certain places than at adjacent locations.

Also known is the process of using squeeze rolls. The liquid that is accumulated in front of the squeeze rolls is then removed laterally at the edges of the flat stock or band. The use of squeeze rolls can, however, have the undesirable effect that the edges of the flat stock are loaded with liquid from the center of the rolling stock. Thus, a relatively large amount of liquid can remain at the edges. Furthermore, the use of squeeze rolls leads to the generation of steam due to the liquid remaining on the stock. Just as in the case of the use of stripping devices, it is also possible that the rolls may float on a liquid film, i.e. the aquaplaning effect, which leaves a residual amount of liquid on the rolling stock, and more particularly, an uncontrolled residual amount of liquid. The floating effect can be especially severe in the case of long squeeze rolls, which tend to bend. The result can be that the liquid is not squeezed off evenly, but rather, large amounts of liquid remain at certain regions of the rolling stock.

The known devices, which work with squeeze rolls, can be subdivided into two-roll systems and three-roll systems.

In the case of the two-roll systems, the rolling stock runs through two squeeze rolls, which are located opposite from each other and which are pressed against the rolling stock on both sides. However, it has been found that a certain amount of film of residual liquid can pass by the squeeze rolls. This is probably due to the hydrodynamic effects caused by the nip-liquid, which is dammed up in front of the squeeze rolls, when viewed in the direction of movement of the conveying means.

A three-roll system, known from U.S. Pat. No. 4,551,878, includes two squeeze rolls above the rolling stock as well as one squeeze roll provided below the rolling stock. The axles of the rolls are parallel to each other and disposed in such a manner that the lower squeeze roll relative to the direction of movement of the rolling stock, is located between the upper squeeze rolls. By means of hydraulic cylinders, the squeeze rolls are pushed against both sides of the rolling stock so that it curves somewhat around each squeeze roll as it passes through the device. The purpose of this measure is to achieve an especially uniform removal of liquid. The squeeze rolls are supported by a plurality of pairs of bearing rolls, by which the bending of the squeeze rolls is counteracted. Like the known two-roll systems, squeeze rolls are disadvantageous in that a certain amount of residual liquid always remains on the rolling stock. Also, this device is unsuitable for rolling stock which is especially soft, because plastic deformations of the rolling stock can occur during its passage through the array of squeeze rolls with all the related disadvantages.

It has also been proposed to remove the liquid on the rolling stock, such as oil, by chemical means. During the application of the chemical processes it is, however, disadvantageous that the rolling process liquid is lost, because this makes such processes expensive. Often, a complete removal of the rolling process liquid which is always associated with a chemical treatment process is not even desirable. In many cases a certain residual thickness of the liquid film in a precisely distributed uniform thickness should be maintained.

A device and process are known, from DE 2842449, in which an exhaust process is applied between two stripping devices, a chamber being formed between the stripping devices, and thus a vacuum being generated. However, this process is burdened with all the disadvantages of the stripping process. This includes an eventual formation of scratches on the surface of the rolling stock, and under certain circumferences, abrasion occurs on the surface of thin sheet metal as well as a high rate of wear of the stripping device due to the rough surfaces, the sharp and torn edges and the residual chips.

A further device for the removal of liquids from rolling stock is known from FR 2212187. Therein, the rolling stock is transported between two chambers which are open toward the rolling stock and closed off, respectively, from the rolling stock. The side walls of the chambers, which are disposed transversely to the direction of movement of the rolling stock and symmetrically relative to the plane of the rolling stock, are opposite each other and form a gap at their open ends, through which the rolling stock can pass. The lower chamber is in a fixed location, and the upper chamber is positioned in such a way that its height can be varied by means of a pressure cylinder. In these chambers, compressed air is introduced under a pressure which is sufficient to lift both chambers some distance from the surface of the rolling stock against the force exerted by the pressure cylinder. The air, which flows at a high rate of speed through the narrow gap which is formed jointly with the rolling stock, serves the purpose of blowing against the liquid carried along with the rolling stock and of atomizing the liquid. With this device, the rolling stock is supported by an "air cushion" and thus transported between the chambers without being subjected to mechanical stresses; however, the amount of energy required for generating the air cushions is relatively high. It is also a considerable disadvantage that the liquid exposed to the air blast escapes uncontrolled into the vicinity of the device and that the liquid cannot be conveyed to a recovery system for reuse, which burdens the air of the environment. Furthermore, the high air velocity in the gaps, which is required for an effective blowing-off process, and the expansion of the air toward the outside is accompanied by a considerable noise level, which is also a disadvantage.

A known drying facility is further shown in GB 272014. A flat stock includes a chamber which is limited to the immediate liquid wedge area in front of the second roll (as viewed in the direction of motion of the flat stock). The region of the flat stock between the rolls, which are adjacent to one side of the flat stock, is not exposed to the air stream. By means of this specifically targeted local restriction, liquid, which had accumulated in the region of the liquid wedge and which had been squeezed from the corresponding roll, should be collected as a volume of liquid in the liquid wedge chamber. The air stream, which is conveyed through the necessarily small residual volume of the liquid wedge chamber, thus does not come in contact with the surface of the flat stock itself. Instead, the air stream comes in contact with the housing located above it and with the corresponding roll, as well as with the surface of the accumulating, squeezed-off volume of liquid, which is being pulled along with it by the purely mechanical action of the necessarily rapidly flowing gas stream. In order to achieve such a formation of a volume for the liquid wedge between two adjacent rolls on the same side of the flat stock, a housing surface is contemplated which extends across the entire width of the flat stock. The housing forms, in conjunction with the surface of the flat stock, between the two rolls a gap which is very narrow and bounded by parallel surfaces. This prevents the flow of a significant amount of gas through this gap.

SUMMARY OF THE INVENTION

It is the object of the invention to create a process as well as a device for carrying out the process, where the abrading mode of operation of the stripping process can be avoided without burdening the process or the device with the disadvantages of the squeezing rolls, particularly the region around the edge of the flat stock.

This problem is solved according to the invention by placing an array of at least two rolls upon the flat stock, preferably a rolling stock, which are positioned one behind the other and which are closed off toward the top by a housing and which thus form an exhaust chamber from which the liquid is to be removed and/or exhausted. As used herein, the term "rolling stock" is a flat stock which is moved through a process or device. Further, as used herein, the term "edge of rolling stock" and similar expressions simply refers to the edge of the flat stock which happens to be rolling.

The invention has the consequence that all unnecessary application of stress to the rolling stock due to a method of operation, in which a drag is applied, is avoided. In this manner the formation of scratches, a high rate of wear of the devices associated with this process, including the abrasion of black plate, and the disadvantages associated with the blast knife and the squeeze roll are avoided. It is the principal function of the rolls to seal off the exhaust chamber from the rolling stock without generating drag. It will be appreciated that the exhaust chamber is formed by the rolls and the housing.

Especially advantageous is a device in which the exhaust chamber is open toward the edge of the flat stock and has an upper wall generally parallel with the flat stock. Thus a uniform flow from the outside toward the inside through the exhaust chamber is assured and enhanced. The device provides for an exhaust process in the center of the device the exhaust chamber and the array of at least two rolls being disposed across the entire band width of the rolling stock. The flat surfaces defining the chamber and the central location of the exhaust within the chamber leads to high air velocities and better drying results of the rolling stock. The region around the edge of the rolling stock is impinged upon by air flow with a particular intensity, and drying in this region is particularly enhanced.

The invention is basically applicable on only one of the surfaces of the rolling stock. For example, the invention contemplates that liquid is to be exhausted on only one of these surfaces. As is well known, the liquid which is associated with the rolling process and which must be exhausted is normally present on both surfaces of the rolling stock and is advantageously removed from both sides simultaneously with a device according to the invention. For structural reasons, especially in order to achieve the smallest possible size, the invention contemplates two independent devices which work together. One device is placed above the rolling stock and one device is below the rolling stock. Each device includes an array of at least two rolls. In the preferred embodiment, one upper device is located directly above a lower device, the devices being on opposite sides of the rolling stock. However, in certain instances, additional spray application to only one side of the rolling stock is contemplated. The constituency of the liquid to be removed and to be diminished in a controlled manner is different above and below the rolling stock. In such instances, it is advantageous to arrange for the partial devices to be placed on the rolling stock in such a way that they are offset relative to each other.

For rolling stock, which does not carry an excessive amount of liquid, it is advantageous if the axes of rotation of the rolls are perpendicular to the direction of motion of the rolling stock and perpendicular to the plane of the rolling stock. In this way, the stress exerted on the rolls and on the rolling stock is due to drag, etc., is at its lowest. However, it is true that if the rolling stock is burdened with a large amount of liquid, it is then advantageous to place the axes of rotation of the rolls parallel to the plane of the rolling stock and at an angle of more than 90° (preferably about 110°) relative to the direction of movement of the rolling stock, and, thus, to take advantage of an additional effect of the rolls in moving the liquid. In this alternative, the rolls are additionally used as squeeze rolls for squeezing off a part of the quantity of liquid used. The device achieves the objective of a precisely controlled removal of a portion of the liquid, or of a clean finishing device which avoids residual liquid and also functions as otherwise described by the operation of air flow following the squeezing process.

It is of particular advantage to always generate a gap, which is formed by the rolls between the housing unit and the rolls into which gap the liquid penetrates due to the carry-through effect of the rolls and which seals the exhaust chamber. In the case of different liquids, which must be removed from the rolling stock or diminished in controlled manner, it is also advantageous to fashion the gap between rolls in such a way that the gap is adjustable. An adjustable gap achieves optimum sealing. The height adjustment of the exhaust chamber allows the optimum carry-through effect of air to achieve optimum removal efficiency of liquid.

Another aspect of the invention includes not directing the amount of liquid carried along with the roller back to the rolling stock, but instead stripping it off with a stripping device—a technique which can be used to advantage even without the use of an exhaust process or a blowing-off process. This stripping device can be connected permanently to the housing unit or, an advantage with regard to maintenance, it can consist of an insert for rapid changes. The stripping devices can also include a drainage means and/or an exhaust passage which is connected to the exhaust device.

The front and the rear rolls of an array consisting of two rolls generally receive different amounts of liquid. This fact can be taken into account by assigning different roll diameters to a pair of rolls. The advantage of this aspect of the invention is that the rear roll can be smaller than the front roll and that material and structural components within the rolls can thus be saved.

In the case of where a very wide rolling stock is to have liquid removed, a large roll width is necessary. This leads to a considerable construction effort for the rolls, which is associated with a considerable use of material. It is, therefore, advantageous to use a design, in which relatively simple rolls are used. This design, contemplated in the invention, utilizes rolls which are pushed against the rolling stock by various additional push-on rolls or a push-on cylinder. Thus, excess bending is avoided.

The effect of the exhaust chamber can be further increased by blowing a gas (preferably air) with a conventional blower at the edge or edges of the flat stock or letting air impinge through a nozzle into the exhaust chambers (preferably away from the edge of the flat stock and/or within the chamber across portions or across the entire width of the rolling stock). In either event, the fog generated from this gas/liquid mixture can then be exhausted. It can also be advantageous, under certain conditions, to guide the rolling stock by force and to use rolls, which extend beyond the edges of the rolling stock. By means of this approach, the edges of the rolling stock can be impinged upon particularly intensively by a directed stream of gas.

The efficiency of the device can be significantly increased, in particular, by propelling gas, preferably environmental gas, through a nozzle against the rolling stock. The gas would be directed in at least one chamber formed by two adjacent rolls and a housing unit. The process thus results in the liquid present on the rolling stock being at least partly blown off. The blowing is accomplished with the above referenced conventional blower. By means of an exhaust channel communicating with the chamber, the liquid, which is present in the chamber as a spray fog, can be completely exhausted before it can disperse uncontrollably in the environment. A differential pressure vacuum is created in the exhaust chamber and exhaust channel by the movement of the rollers and the rolling stock. Thus, air is naturally caused to flow across the stock within the exhaust chamber and out the exhaust channel. Alternatively, a conventional vacuum system which may be used at the outlet end of the exhaust connection supplements the natural differential pressure vacuum and/or the conventional blower for causing air to flow across the stock. In this manner, the proportion of the recyclable liquid is increased considerably as compared to known devices in which the liquid is removed from the rolling stock or its amount reduced by means of a blow knife.

In certain cases, it is necessary to lower significantly the properties of the liquid (i.e., the viscosity) prior to its removal. Where necessary, a high pressure washing unit is placed upstream of the device for removing or reducing the amount of liquid remaining on the rolling stock after the rolling process. Thus, the mixture of washing agents and liquid can be removed as described above. The washing device can consist either of a spray device or an application roll.

Likewise, it is advantageous under certain conditions (especially for structural reasons) to apply media immediately after the removal or the controlled reduction of the amount of liquid; for example, a base coat, corrosion protection material, etc., to the rolling stock. It can, for example, consist of a spray device, which is located behind the exit rolls, which may be optionally equipped with means for exhausting the excess fog (FIG. 8). Such an embodiment of the device is especially to be preferred if the medium applied to the rolling stock is to form a particularly uniform layer. In other cases, the excess fog can be avoided and thus the means for exhausting can be dispensed with, if the device consists of one or several application rolls following the exit rolls, which may be, for example, equipped with a textile surface or the like (FIG. 12).

The above-mentioned procedural steps, as well as those which are claimed and those described in the subsequent embodiment, and the structural components, which are to be used according to the invention, are not subject to special and exceptional requirements with regard to their size, form, use of material and selection of material, and their technical concepts or their processing requirements, so that the application criteria known for the various areas of use can be implemented without restrictions.

Further objects and advantages of the invention will become apparent to those skilled in the art upon reading and understanding the detailed description of the invention set forth below.

BRIEF DESCRIPTION OF THE DRAWINGS

Reference may now be had to the drawings, which illustrate various embodiments that the invention may take in physical form and in certain parts and arrangement of parts wherein.

PREFERRED EMBODIMENTS

Figure 1:
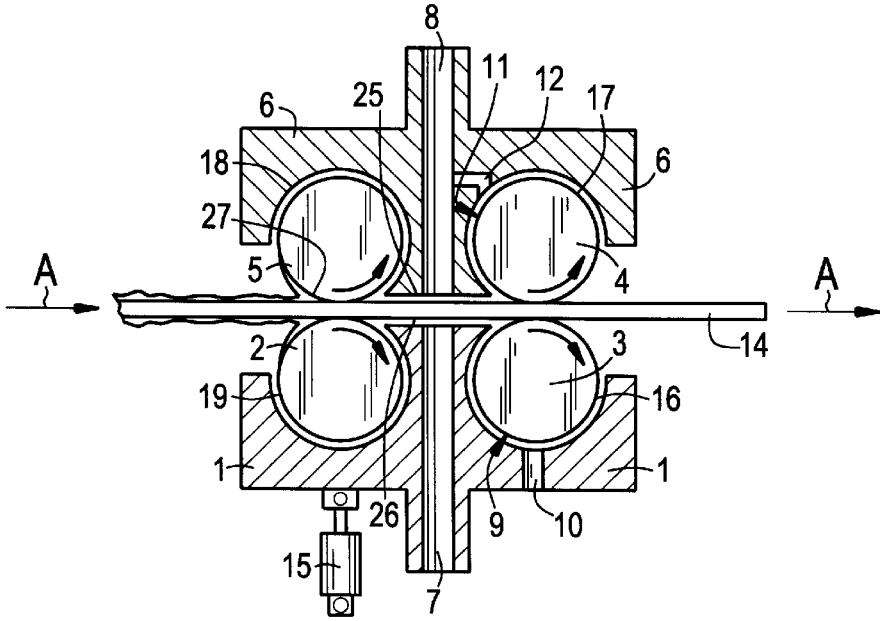
FIG. 1 is an elevation view of the device in accordance with the present invention.

In FIG. 1, a device for the removal or the controlled reduction of the amount of liquid remaining on the rolling stock 14 or a similar flat stock after a rolling process or another manufacturing process is shown. The rolling stock 14, which has liquid adhering to it on both sides, is transported from left to right in the example of the embodiment. The liquid to be removed can be water, oil, an emulsion, kerosene, solvent (also on a water basis), acids, bases, or something else. The rolls 2, 3, 4, 5 shown in the embodiment run largely without slippage along with the rolling stock and form, together with the housing units 1 and 6, a lower and an upper "suction" chamber 25 and 26, from which the liquid (as a rule the liquid droplets pulled along by an air current) is exhausted or carried away by way of a lower and an upper "suction" connection 7 and 8, the latter if air/gas is blown from the ends of the rolls into the chambers, which can be assisted by an exhaust process as will be described later. The entry and exit slots 16, 17, 18, 19 are shaped like cylinder rings and are between the rolls and the housing units by virtue of the housing contour. Entry and exit slots 16, 17, 18, 19 are coaxial with the rolls and leave a gap open in the vicinity of the rolls. The exhaust chambers 25, 26 are otherwise sealed by the rolls 2, 3, 4, 5 in and opposite to the direction of motion of the rolling stock.

Figure 2:
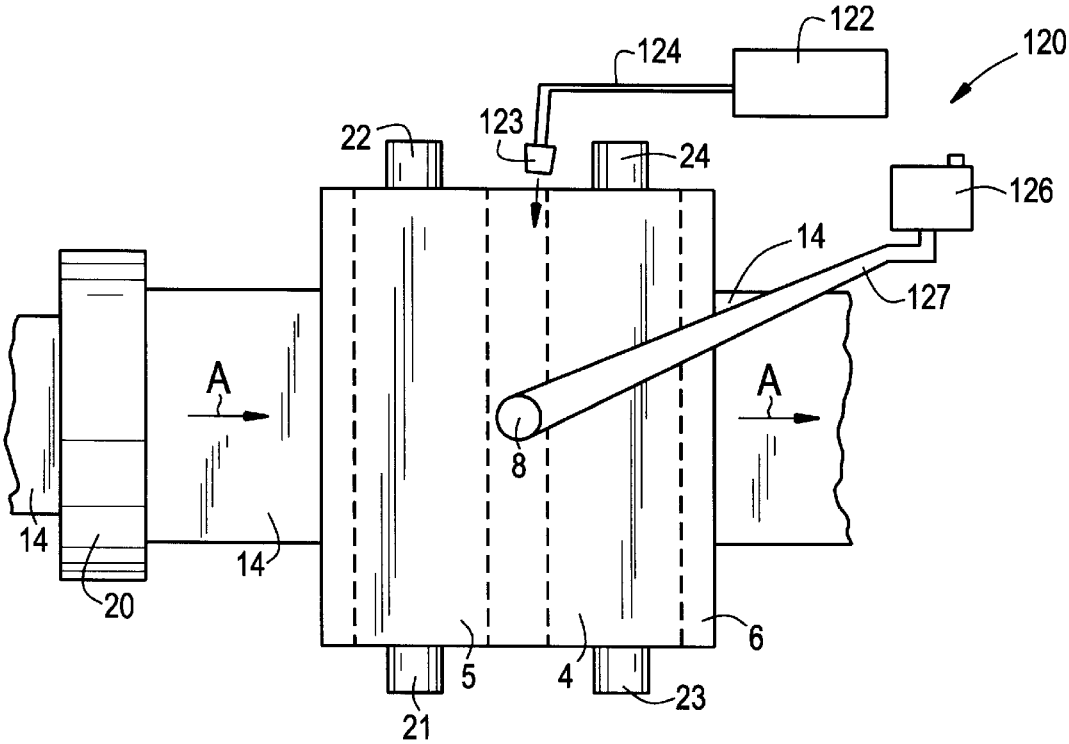
FIG. 2 is a plan view of the device shown in FIG. 1 with the additional inclusion of a rolling unit.

The exhaust chambers 25, 26 are open at the edge of the flat stock, so that the air (the environmental gas) flows from the outside into the chamber across the edge of the flat stock. The stream of gas is generally caused by the differential pressure vacuum created by the rollers and exhaust chamber therebetween. This differential pressure creates and causes the air flow from outside the edge of the flat stock into the chamber 25, 26. The technical success of the invention is greatly enhanced by the fact that each of chambers 25, 26 between the rolling stock 14 and housing units 1,6 is flat, i.e. the edge of housing units 1,6 forming the upper wall of chambers 25, 26, and adjacent rolling stock 14 is generally parallel with the rolling stock 14. Further, the inlet end of suction pipes 7, 8 in the housing units 1, 6 are in the center and centrally located between rolls 2, 3 and rolls 4, 5, respectively. As also shown in FIG. 2, suction pipes 7, 8 are located centrally between opposite side edges of housing units 1, 6, when measured perpendicular to the direction A of rolling stock 14. This flatness and overall geometry within chambers 25, 26 leads to high air velocities and better drying results of stock 14, especially close to the side edges of rolling stock 14.

In order to supplement the natural differential pressure, a conventional exhaust system 120 is provided. As shown in FIG. 2, such system 120 includes the combination of a blower 122, a nozzle 123, and an air supply line 124 therebetween. Blower 122 supplies air to nozzle 123 which is directed across the flat stock 14. It will be appreciated that more than one nozzle could be used as well as directing air from the opposite edges of flat stock 14. Also included in system 120 is a vacuum 126, used instead of or to supplement blower 122 to increase air flow across flat stock 14. Vacuum 126 is connected to lower and upper suction connections 7 and 8 via vacuum line 127. Either or both of blower 122 and vacuum 126 of system 120 may be used to supplement the natural differential pressure vacuum created by movement of the rollers in the exhaust chamber. Though not shown, it will be appreciated that each of the alternative embodiments of the present application also contemplate and include an exhaust system 120 to supplement the natural differential pressure vacuum.

In the preferred embodiment, the gaps between rolls as well as the height of the exhaust chambers are adjustable by means of mechanical adjustments. The adjustment has the purpose of affecting in particular the flow conditions in view of varying viscosities and amounts of the liquid to be removed or the amount of which is to be reduced in a controlled manner. However, the general geometry, i.e. the upper wall of chambers 25, 26 being generally flat and parallel with rolling stock 14, and the central location of the inlet end of suction connections 7,8 within housing units 1,6 does not change despite this adjustibility feature.

In the embodiment according to FIGS. 1 and 2, the rolls are placed on the top and bottom surface of the rolling stock, and always opposite and transverse to the direction of motion of the rolling stock.

Figure 3:
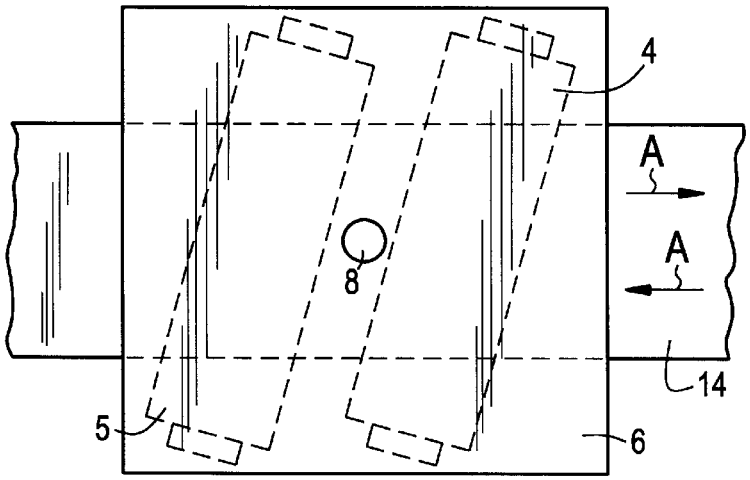
FIG. 3 is the device shown in FIG. 2 according to the invention and having the rolls at an angle relative to the rolling stock.
Figure 6:
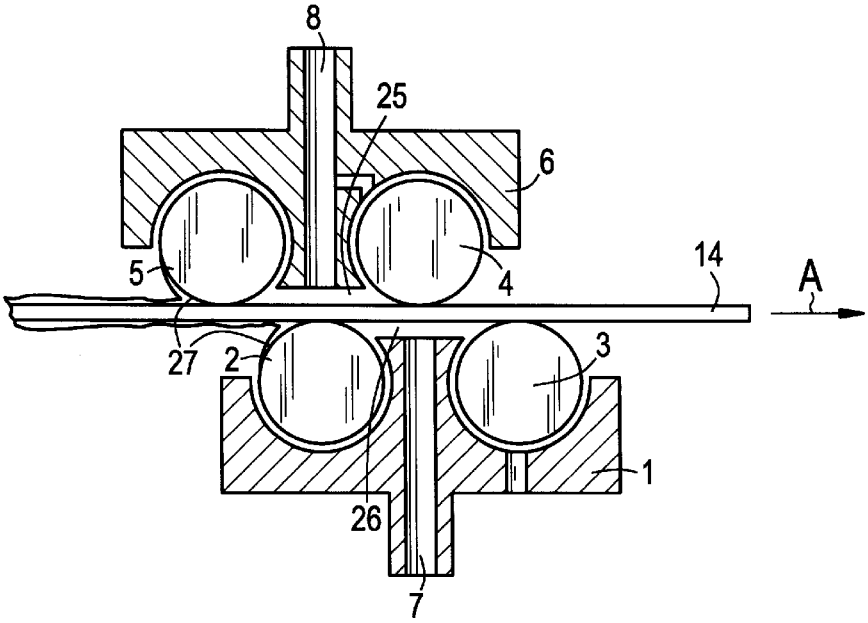
FIG. 6 is another embodiment of the device in accordance with the present invention where the devices disposed above and below the rolling stock are offset relative to each other in the direction of motion of the rolling stock.

Alternatively, embodiments are also proposed in which the rolls are disposed in such a manner that they are offset from each other as in FIG. 6, and/or transverse to the direction of motion of the rolling stock, as in FIG. 3. As shown in FIG. 3, rolls 4, 5 are at an angle relative to the direction A of rolling stock 14. Such angle is greater than 90° and preferably 110°, though angles between 90° and 110° have been found to be effective.

It will be appreciated that liquid is carried along by the rolls through the slots 16 and 17 between rolls 3 and 4. In the example of the embodiment of FIGS. 1 and 2, the potential of the device for removing liquids is further enhanced in that the liquid carried by the rolls is removed from the rolls 4 and 3, respectively, by the stripping devices 9 and 11. Stripping devices 9 and 11 provide sealing toward the exhaust chamber 25 and 26, respectively. Liquid is disposed of by an additional discharge passage 12 at the top, while it is removed at the bottom by a drainage passage 10. The passage 12 is also connected (not shown) to the exhaust system 120 by means of the upper exhaust connection 8, just like the upper exhaust chamber 25. In the example of the embodiment, the additional stripping devices 9 and 11 are permanently connected to the housing units 1 and 6;

however, they can also be inserted interchangeably as quick-change inserts into the housing units.

In front of the rolls, especially the entry rolls 2 and 4, a liquid wedge or hydrodynamic lubrication wedge 27 is generated on both sides of the rolling stock. Especially in an embodiment according to FIG. 3, in which the rolls 4, 5 are disposed transversely to the direction of movement of the rolling stock 14, this liquid can run off toward the ends of the rolls, which ends are directed toward the front with respect to the direction of movement of the flat stock. This additional run-off function increases the potential of the device to remove liquids.

In the embodiment according to FIGS. 1 and 2, an additional push-on cylinder designated as 15 is mounted, which is able to prevent bending of the lower roll 2.

Figure 4:
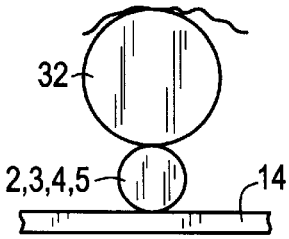
FIG. 4 is an illustration of a roll in a side view, which is pushed against the rolling stock by a push-on roll.
Figure 5:
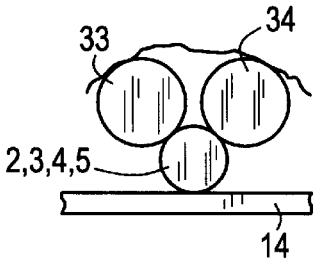
FIG. 5 is an elevation illustration of a roll, which is pushed against the rolling stock by two push-on rolls acting upon the roll.

In an alternate embodiment, a further, additional push-on roll 32, which acts upon the rolls 2 to 5 (and an example of which is shown in FIG. 4) is contemplated instead of the additional push-on cylinder. This push-on roll achieves the same objective as the push-on cylinder. However, according to FIG. 5, it still continues to be possible to provide two push-on rolls 33, 34 for each roll 2 to 5, which then laterally guide at the same time each of the rolls 2 to 5, respectively.

In order to further increase the removal potential, an additional washing device (high pressure washing device), not shown in the drawing, can be provided in front of the device proper for the removal or controlled reduction of the amounts of liquids, with which solid particles can be washed off. The washing unit is also capable of applying solvents, especially liquids, which can dissolve grease or other liquids as well, which lower the viscosity of the liquids present on the rolling stock, and to remove the solvent/grease mixture in the device according to the invention.

Figure 7:
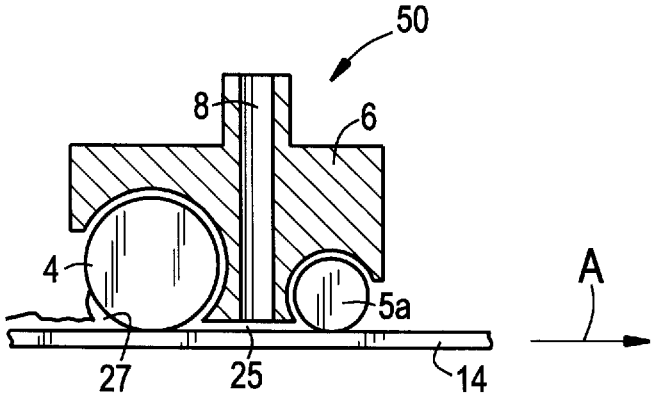
FIG. 7 is the device in an elevation view showing rolls of different diameters.

Because the entry rolls 2, 4 are generally covered with a different amount of liquid than the exit rolls 3, 5, it can be advantageous to provide rolls 2 to 5, which have different diameters, in the housing units 1, 6. As shown in FIG. 7, roll 4 is of standard diameter but rod 5*a* is of smaller diameter than those shown. It is possible to combine this upper device 50 with a correspondingly equipped lower device, or, however, also with one having equal roll diameters. However, any other kinds of combinations are conceivable, depending on the requirements.

Figure 8:
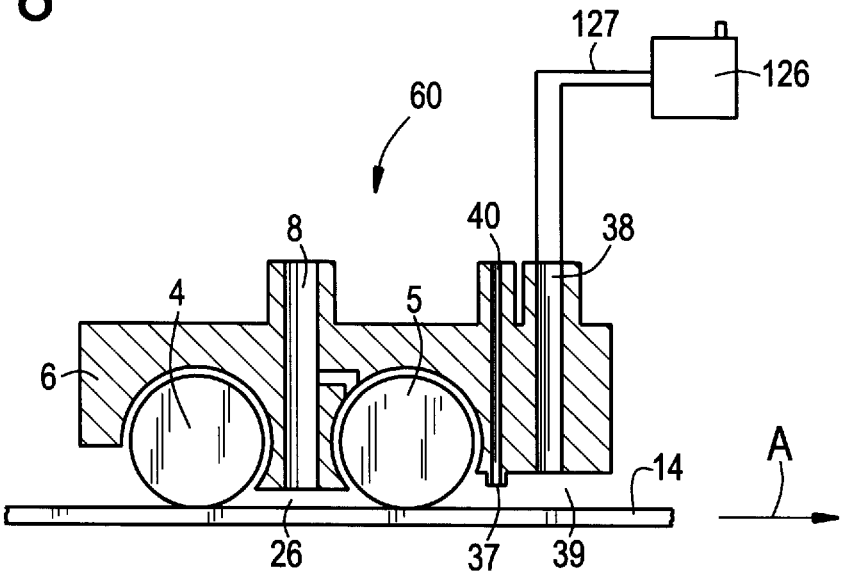
FIG. 8 is another embodiment of the device disposed above the rolling stock in an elevation view, which includes n its housing unit devices for the application of, for example, layers of corrosion protection or drawing oils as well as for exhausting the excess fogs.
Figure 12:
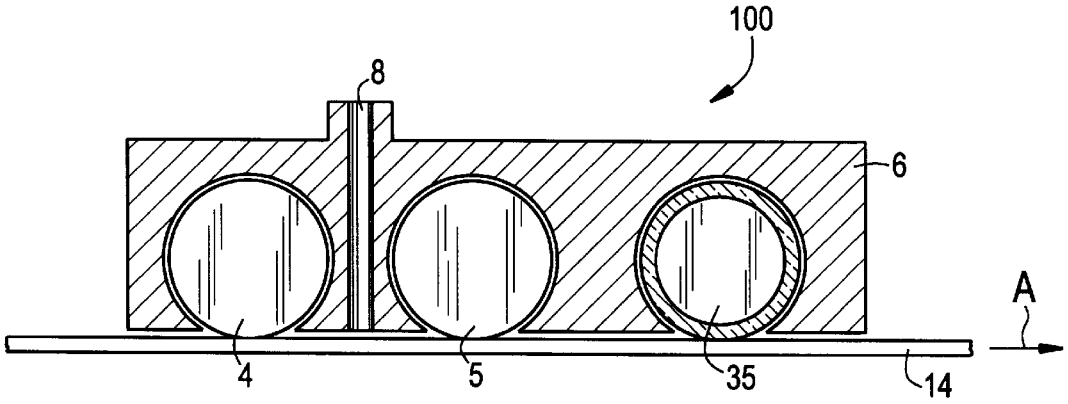
FIG. 12 is a device in an elevation view, in which the exit roll is disposed after an application roll for the application of liquid media (corrosion protection means, drawing oils, etc.); and, FIG. 13 is a two-roll device in an elevation view, at which the widths of the exhaust slots are adjustable by means of an exhaust connection, the height of which is also adjustable.

In FIG. 8 an embodiment is shown which contains an application passage 40 in its upper housing unit 6, and which application passage 40 is positioned behind the upper exit roll 5 relative to the direction of movement of the rolling stock, which terminates at its lower portion, facing the rolling stock 14, in a deposition nozzle 37. Through the deposition nozzle 37, anticorrosion means or drawing oil, for example, are deposited following the removal or reduction of the amount of the liquid, which was initially present on the rolling stock 14. Behind the deposition nozzle 37 an exhaust passage 38 is disposed, which communicates with the region 39 of the excess fog, which is present above the rolling stock 14 by means of a connected exhaust vacuum 126 and vacuum line 127, which is substantially equivalent to that shown in FIG. 2. Thus, fog due to deposition nozzle 37 is exhausted before larger amounts of fog can escape into the environment. The device 60 shown in FIG. 8, on the other hand, can be combined with any lower partial device not shown in the drawing. It is also possible, in accordance with the embodiment of a device 100 shown in FIG. 12, to add a deposition roll 35 subsequent to exit roll 5, which is equipped with a surface (for example, textiles and the like) suitable for the deposition of liquid means. With the use of such an embodiment, excess fogs are avoided, and, under certain conditions, the rolling stock can be targeted for only partial deposition of these media by the use of appropriate deposition rolls.

Figure 9:
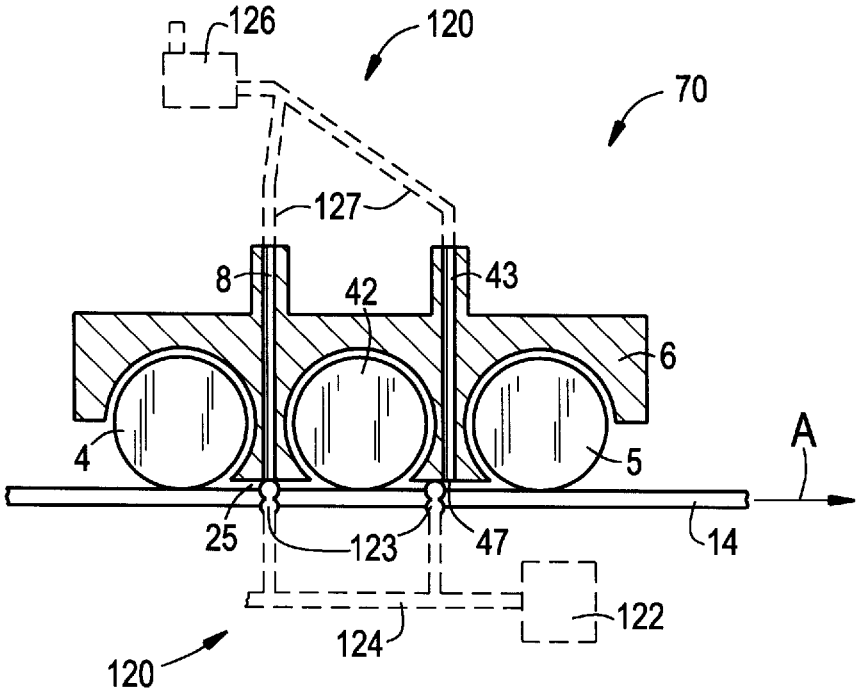
FIG. 9 is a multi-roll device in an elevation view, including three rolls, always between adjacent rolls, and an exhaust process is implemented always between adjacent rolls.

In FIG. 9, a multi-roll system is shown by the example of a device 70, which includes in its upper housing unit 6 three rolls 4, 42, 5 which are disposed one after the other and parallel to each other, which, depending on need, can also have different diameters. From both exhaust chambers 25, 41, which are always disposed between adjacent rolls, liquid droplets which are propelled along with the stream of gas are exhausted through the exhaust connections 8, 43, by which means the ability of the device 70 to remove liquids present on the rolling stock 14 is further enhanced as compared to a two-roll device. It will be appreciated that exhaust connections 8, 43 work in the same manner as described with respect to FIG. 2, i.e. a natural differential pressure vacuum draws air from exhaust chambers 25, 41 and through exhaust connections 8, 43. However, as shown in phantom in FIG. 9, the natural pressure vacuum can be supplemented with an exhaust system 120. Such system 120 includes the combination of a blower 122, at least two nozzles 123, and air supply lines 124 therebetween. Blower 122 supplies air to nozzles 123 which is directed across the flat stock 14. Also included in system 120 is a vacuum source 126, used instead of or to supplement blower 122, to increase air flow across flat stock 14. Vacuum source 126 is connected to lower and upper suction connections 8 and 43 via vacuum lines 127. Either or both of blower 122 and vacuum source 126 of system 120 may be used to supplement the natural differential pressure vacuum created by movement of the rollers in the exhaust chamber.

Figure 10:
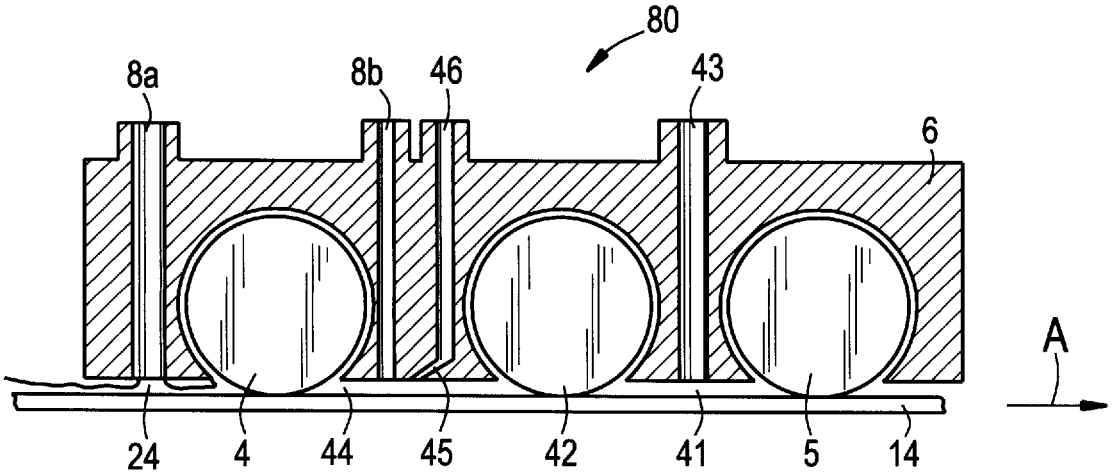
FIG. 10 is a multi-roll device according to FIG. 9 for which, additionally, a connection for exhausting the nip-fluid is shown, as well as a device for the blow-off/exhaust process or for the rinse/exhaust process, which is located in the first chamber, as viewed in the direction of movement of the rolling stock.

A further embodiment of a multi-roll system is shown by the example of the device 80 in FIG. 10. In this embodiment, the removal potential is enhanced by an exhaust connection 8*a,* which is disposed ahead of the entry rolls 2, 4. Exhaust connection 8*a* partially or totally exhausts the liquid wedge or hydrodynamic lubrication wedge 27 (the so-called nip-liquid). At the same time, the risk that the entry rolls 2, 4 may float, and thus the risk of an uncontrolled through passage of liquid, is reduced by exhaust connection 8*a*. In addition to the forward exhaust connection 8*a,* the device 80 also includes a forward blow-off/rinse chamber 44 in the housing unit 6 between the entry roll 4 and the central roll 42. Terminating at rinse chamber 44 is a nozzle 45 of a blow-off/rinse passage 46. A gas, preferably an ambient gas, can be introduced through the blow-off/rinse passage 46 by means of the nozzle 45, which, in this case, is fashioned as a blow knife, and into the blow-off/rinse chamber 44. Thus, an additional liquid can be blown off the surface of the rolling stock 14, which then in turn can be exhausted through an exhaust connection 8*b*. Alternatively, a suitable solvent can be applied through the blow-off passage 46 by the nozzle 45, which now acts as a spray nozzle, onto the surface of the rolling stock 14, which is mixed with the residual liquid film and exhausted through the exhaust connection 8*b*. By the combination of blow-off/exhaust or rinse/exhaust, respectively, in a blow-off/rinse chamber 44, the efficiency of the device can be increased significantly.

Figure 11:
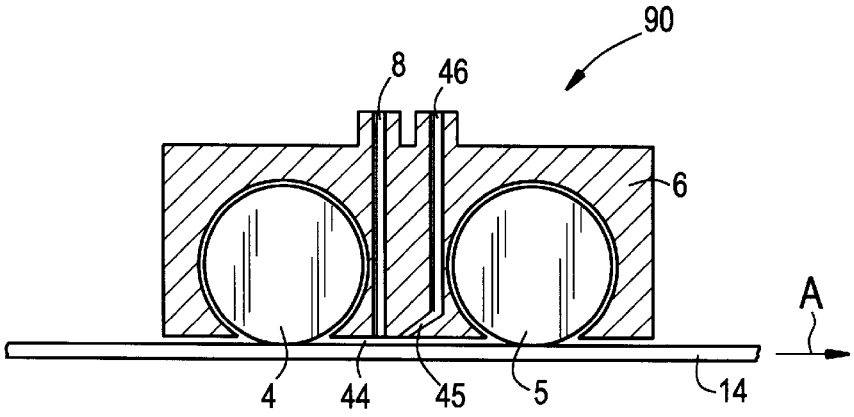
FIG. 11 is a two-roll device in an elevation view, in the chamber of which a blow-off/exhaust device or a rinse/exhaust device is shown.

If in the case of the device 80 according to FIG. 10 a pure exhaust chamber 41 with an exhaust connection 43 is installed after the rinse chamber 44, then it may also be advantageous (as shown in FIG. 11) to construct the chamber of a two-roll device 90 as a blow-off/rinse chamber 44.

Figure 13:
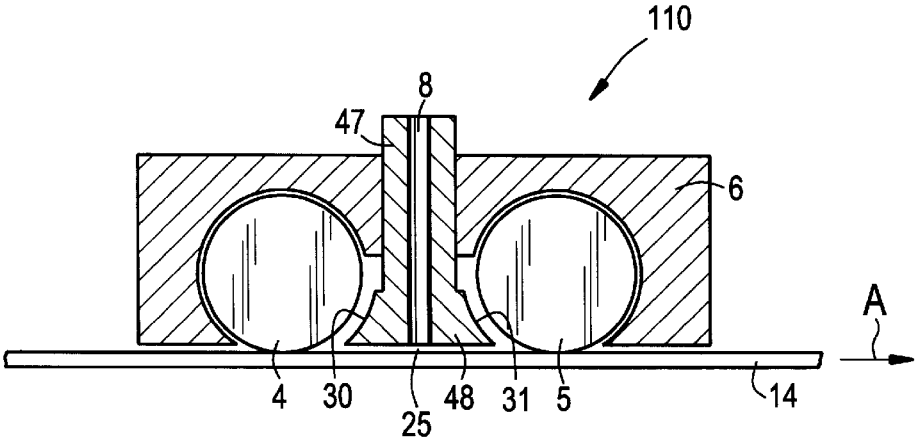

In FIG. 13, a device 110 is shown, in which the front and rear exhaust slots 30, 31 (which are formed between the rolls 4, 5 and the housing unit 6 inside the exhaust chamber 25)

can be varied with regard to their width in order to control the potential for removing liquid of the device 110. This can be done, according to FIG. 13, in a simple manner by placing a housing part 48, which partially encloses the surfaces of the rolls 4, 5 inside the exhaust chamber 25, at the lower end of an exhaust tube 47, which is placed in the housing unit 6 in such a way that its height can be varied.

Having thus described the invention, it is claimed:

1. A device for the removal and controlled reduction of the amount of a liquid remaining on a flat stock having a surface and having a width defined between two opposing edges, said flat stock moving through said device in a direction generally parallel to said opposing edges, such as after a rolling process, said liquid forming a film of moisture on said flat stock, said device comprising at least two rolls with central axes, said at least two rolls being placed upon the flat stock and spaced apart in said direction and said central axes being transverse to said direction, said device further comprising at least one housing unit and at least one exhaust chamber which is open toward the opposing edges of the flat stock and always located between two adjacent rolls of said at least two rolls, said at least one exhaust chamber being formed jointly by said surface, said two adjacent rolls and said at least one housing unit, said device further comprising means for flowing a stream of gas across the flat stock from at least one of the opposing edges of the flat stock and toward an exhaust connection of the at least one exhaust chamber, and means for the removal of the gas and the liquid therein from the at least one exhaust chamber.

2. The device according to claim 1, wherein the at least two rolls are placed upon the flat stock across the width of the flat stock.

3. The device according to claim 2, wherein said at least two rolls includes an upper roll and a lower roll, said upper roll lying above said lower roll at the same location.

4. The device according to claim 2, wherein the rolls are lying on the at least flat stock in such a manner that they are offset relative to each other.

5. The device according to claim 1, wherein said flat stock has a top side and a bottom side and both said top side and said bottom side include said at least two rolls and said exhaust chamber with said means for removing the gas and the liquid therein out of the exhaust chamber.

6. The device according to claim 1, wherein said at least two rolls each have an axis of rotation located approximately at right angles to the direction of movement of the flat stock as well as approximately parallel to the surface of the flat stock.

7. The device according to claim 6, wherein at least one of the rolls is engaged by a stripping device.

8. The device according to claim 7, wherein the stripping device is connected to the at least one housing unit.

9. The device according to claim 7, wherein said at least one housing unit includes a lower housing unit and an upper housing unit, said upper housing unit comprises at least one stripping device in conjunction with one roll of said at least two rolls, and the lower housing unit includes a passage for removing liquid ahead of the stripping device in said direction.

10. The device according to claim 1, wherein the axis of rotation of each of the rolls is located approximately parallel to the surface of the flat stock and at an angle of between 90° and 110° to the direction of movement of the flat stock.

11. The device according to claim 1, wherein a roll gap is formed between the at least one housing unit and each roll of the at least two rolls.

12. The device according to claim 1, wherein the exhaust chamber has a height and the height of the exhaust chamber is adjustable.

13. The device according to claim 1, including a hydrodynamic lubrication wedge formed by the at least two rolls which are placed one behind the other in said direction, said at least two rolls having different roll diameters.

14. The device according to claim 1, including an additional push-on at least two roll for pressing at least one of the rolls against the flat stock.

15. The device according to claim 1, including a push-on cylinder for pressing at least one of the at least two rolls against the flat stock.

16. The device according to claim 1, including means for blowing off the liquid in the at least one exhaust chamber.

17. The device according to claim 16, wherein at least one of the at least one exhaust chamber is fashioned as a blow chamber, in which a blow nozzle propels a gas upon the flat stock, and the blow chamber includes an exhaust connection which serves to exhaust the gas which has been propelled through the blow nozzle.

18. The device according to claim 16, wherein the means for blowing off the liquid are disposed on at least one of the opposing edges of the flat stock.

19. The device according to claim 1, including a high-pressure washing device located upstream of a first roll of the at least two rolls based on the direction of movement of the flat stock.

20. The device according to claim 1, including means for the deposition of liquids onto said flat stock, which means is located downstream of a last roll of the at least two rolls based on the direction of movement of the flat stock.

21. The device according to claim 1, wherein said at least one housing unit includes a lower end forming an upper wall of the at least one exhaust chamber, said lower end being generally parallel with said surface of the flat stock.

22. The device according to claim 21, wherein said exhaust connection opens through said upper wall generally centrally between said two adjacent rolls.

23. The device according to claim 1, wherein said exhaust connection is located generally centrally between said two adjacent rolls.

24. A process for the removal or the controlled reduction of the amount of liquid remaining on a flat stock having two opposing edges after a rolling process, said flat stock moving in a direction generally parallel to said opposing edges, said process comprising placing at least two rolls located one after the other upon the flat stock, and forming a common chamber between two adjacent rolls in conjunction with these and at least one housing unit, and where a film of moisture from said liquid is present between the adjacent rolls on the flat stock, removing said film of moisture solely by flowing a gas stream across the film of moisture, including directing a gas stream transversely across the direction of motion of the flat stock from at least one of the edges of the flat stock toward an exhaust connection and exhausting said gas stream through this chamber and, removing said gas stream from the chamber by way of an exhaust connection opening located opposite to the flat stock.

25. A device for removal and controlled reduction of an amount of a liquid remaining on a flat stock having two opposing edges and a width and a surface between said two opposing edges, said flat stock moving through said device in a direction generally parallel to said opposing edges, such as after a rolling process, said liquid forming a film of moisture on said flat stock, said removal caused by a gas stream which flows across the film of moisture on said flat stock, at least two rolls with central axes and which are placed upon the flat stock and disposed on said flat stock surface transverse to the direction of movement of the flat stock, said device further comprising a plurality of exhaust chambers which are open toward the opposing edges of the flat stock and have an exhaust connection, each of said plurality of exhaust chambers always located between two adjacent rolls of said at least two rolls and formed jointly by said two adjacent rolls, said surface and at least one housing unit, said device further comprising means for exhausting said gas stream to said exhaust connection of said exhaust chambers for the removal of the gas stream and the liquid therein from the exhaust chamber.

26. The device according to claim 25, wherein the at least two rolls are placed upon the flat stock across the width of the flat stock.

27. The device according to claim 26, wherein said at least two rolls includes an upper roll and a lower roll, said upper roll lying above said lower roll at the same location.

28. The device according to claim 26, wherein the at least rolls are lying on the flat stock in such a manner that they are offset relative to each other.

29. The device according to claim 25, wherein said flat stock has a top side and a bottom side and both said top side and said bottom side include said at least two rolls, said plurality of exhaust chambers and said means for exhausting said gas stream for the removal of the gas stream and the liquid therein out of the exhaust chamber.

30. The device according to claim 25, wherein said rolls each have an axis of rotation located approximately at right angles to the direction of movement of the flat stock as well as approximately parallel to the surface of the flat stock.

31. The device according to claim 30, wherein at least one of the rolls is engaged by a stripping device.

32. The device according to claim 31, wherein the stripping device is connected to the housing unit.

33. The device according to claim 31, including an upper housing unit and a lower housing unit and wherein at least one housing unit includes at least one stripping device in conjunction with one roll of the at least two rolls and the lower housing unit includes a passage for removing liquid ahead of the stripping device in said direction.

34. The device according to claim 25, wherein the axis of rotation of each of the rolls is located approximately parallel to the surface of the flat stock and at an angle of between 100° and 110° to the direction of movement of the flat stock.

35. The device according to claim 25, wherein a roll gap is formed between the at least one housing unit and each roll of the at least two rolls.

36. The device according to claim 25, wherein the plurality of exhaust chambers each have a height and the height of each exhaust chamber is adjustable.

37. The device according to claim 25, including a hydrodynamic lubrication wedge formed by the at least two rolls which are placed one behind the other in said direction, and said at least two rolls having different roll diameters.

38. The device according to claim 25, including an additional push-on at least two roll for pressing at least one of the rolls against the flat stock.

39. The device according to claim 25, including a push-on cylinder for pressing at least one of the at least two rolls against the flat stock.

40. The device according to claim 25, including means for blowing off the liquid in the at least one exhaust chamber.

41. The device according to claim 40, wherein at least one of the at least one exhaust chamber is fashioned as a blow chamber, in which a blow nozzle propels a gas upon the flat stock, and the blow chamber includes an exhaust connection which serves to exhaust the gas which had been propelled through the blow nozzle.

42. The device according to claim 40, wherein the means for blowing off the liquid are disposed on at least one of the opposing edges of the flat stock.

43. The device according to claim 25, including a high-pressure washing device located upstream of a first roll of the at least two rolls based on the direction of movement of the flat stock.

44. The device according to claim 25, including means for the deposition of liquids onto said flat stock, which means is located downstream of a last roll of the at least two rolls based on the direction of movement of the flat stock.

45. The device according to claim 25, wherein said exhaust connection opening is located opposite and coplanar to said flat stock.

46. The device according to claim 25, wherein said at least one housing unit includes a lower end forming an upper wall of said exhaust chamber, said lower end being generally parallel with said surface of the flat stock.

47. The device according to claim 46, wherein said exhaust connection opens through said upper wall generally centrally between said two adjacent rolls.

48. The device according to claim 25, wherein said exhaust connection is located generally centrally between said two adjacent rolls.

49. A process for the removal or the controlled reduction of the amount of liquid remaining on a flat stock having two opposing edges after a rolling process, said flat stock moving in a direction generally parallel to said opposing edges, said process comprising placing at least one pair of rolls upon the flat stock, each pair including two adjacent rolls located one after the other, each said pair of rolls forming a common chamber between said two adjacent rolls comprising said pair, said chamber additionally formed by at least one housing unit, said chamber having an exhaust connection opening extending therefrom and where a film of moisture from said liquid is present between the adjacent rolls on the flat stock, removing said film of moisture solely by a gas stream flowing across the film of moisture, including said gas stream flowing transversely across the direction of motion of the flat stock from at least one of the edges of the flat stock toward said exhaust connection and exhausting said gas stream through said chamber and, removing said gas stream from the chamber by way of said exhaust connection opening located opposite to the flat stock.

* * * * *